US005544440A

United States Patent [19]

Stockman

[11] Patent Number: 5,544,440

[45] Date of Patent: Aug. 13, 1996

[54] GUN LOCK

[76] Inventor: Gregory W. Stockman, 35 E. L St., Sparks, Nev. 89431

[21] Appl. No.: 203,994

[22] Filed: Feb. 28, 1994

[51] Int. Cl.[6] ..... F41A 17/54

[52] U.S. Cl. ..... 42/70.07; 42/70.06

[58] Field of Search ..... 42/70.07, 70.06, 42/70.11, 70.01

[56] References Cited

U.S. PATENT DOCUMENTS

| | | | |
|---|---|---|---|
| 2,742,726 | 4/1956 | Feller | 42/70.07 |
| 3,139,694 | 7/1964 | Schaefer | 42/70.07 |
| 3,616,559 | 11/1971 | Sobolewski | 42/70.07 |
| 4,030,221 | 6/1977 | Doobenen et al. | 42/70.07 |
| 4,509,281 | 4/1985 | Dreiling et al. | 42/70.07 |
| 4,934,083 | 6/1990 | Smith | 42/70.07 |

FOREIGN PATENT DOCUMENTS

| | | | |
|---|---|---|---|
| 968669 | 9/1964 | United Kingdom | 42/70.07 |

OTHER PUBLICATIONS

Guns and Ammo, Stainless Steel Quick–Release Lock, Aug. 1987.

*Primary Examiner*—Stephen M. Johnson
*Attorney, Agent, or Firm*—Brian C. Kelly

[57] ABSTRACT

An external firearm safety device which gives clear visual indication that the safety is in place and provides a positive lock which is resitant to children removing the lock and being able to fire the firearm and foremost provides a quick release method so the firearm would be available for home protection in exigent circumstances.

2 Claims, 2 Drawing Sheets

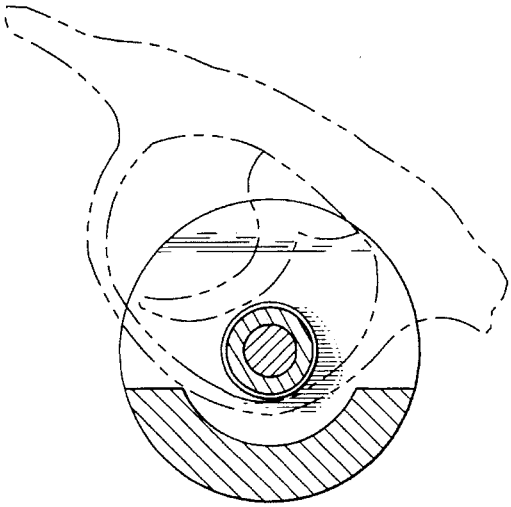
Fig. 4
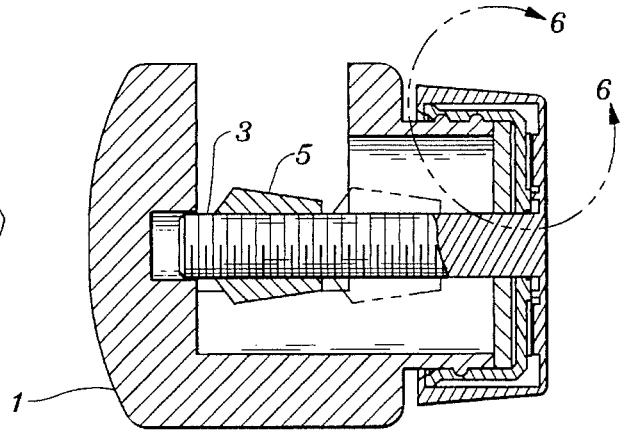
Fig. 5
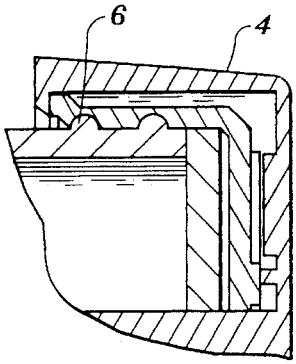
Fig. 6
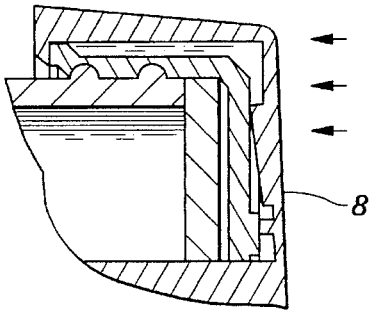
Fig. 7
Fig. 8
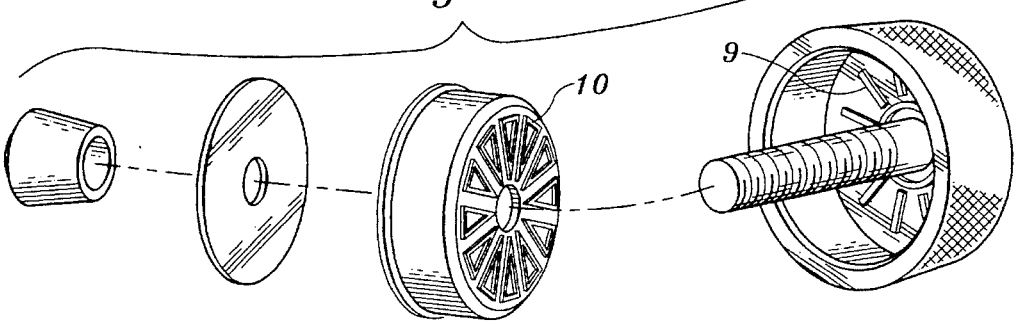

GUN LOCK

FIELD OF THE INVENTION

This invention relates generally to the field of firearm safety devices.

BACKGROUND

The prior art contains internal safety devices for guns as most firearms made in the last 25 years have included. This invention relates to external safety devices for guns, which provide positive visual evidence that the gun is secured, giving a gun owner some confidence in the security of the gun.

One of the primary problems with gun safety devices is that if they are internal it is difficult to view the gun and determine whether it is loaded, unloaded and on safety or off safety, except upon close inspection.

The prior art includes certain trigger guard locks which are locks that are engaged via key means and are placed in the interstice between the front of the trigger guard and the trigger so that a finger cannot be placed into the trigger in order to actuate it. This sort of trigger guard lock provides the visual safety superior to the internal safety mechanisms, however, since it is actuated by a key it defeats the home safety purposes of a firearm because unless the homeowner and firearm operator has the key at hand, the gun would be unavailable to protect the homeowner and his family or property.

The present invention overcomes the shortcomings of the prior art by combining a external safety device which gives clear visual indication that the safety is in place and provides a positive lock which is resistant to childrens removing the lock and being able to fire the weapon and foremost provides a quick release method so that the gun would be available for home protection in exigent circumstances.

OBJECTS OF THE INVENTION

First object of the invention is to provide an external gun safety device capable of rendering a firearm inoperable.

Second object of the invention is to provide an external firearm safety device that is child resistant, however, is easily removable by an adult so that the gun can be stored within easy reach of adults.

SUMMARY OF INVENTION

An external firearm safety device including a block for fitting over a trigger guard of a firearm and a post for insertion in an interstice between back of said trigger guard and a trigger of said firearm.

A BRIEF DESCRIPTION OF THE DRAWINGS

FIG. 4 Shows a cutaway view of the firearm safety device installed on a firearm.

FIG. 5 Shows a cross-sectional view of the firearm safety device.

FIG. 6 Shows a detailed view of a cross-sectional view of the firearm safety device.

FIG. 7 Shows another detailed view of a cross-section of the firearm safety device with pressure applied for operation.

FIG. 8 Shows an exploded view of the trigger guard portion of the firearm safety device.

DESCRIPTION OF PREFERRED EMBODIMENTS

Figure 1:
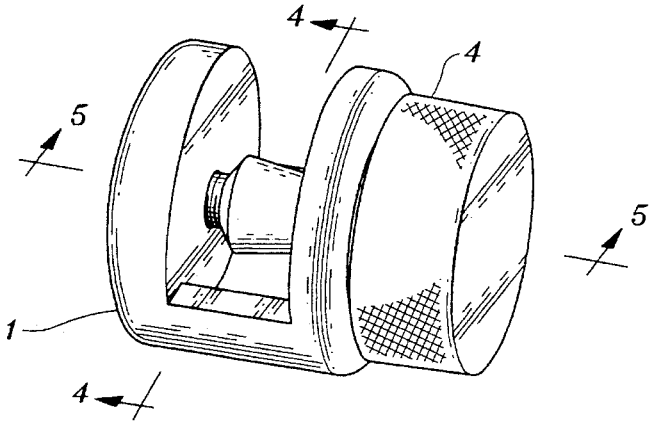
FIG. 1 Shows a perspective view of the firearm safety device.
Figure 2:
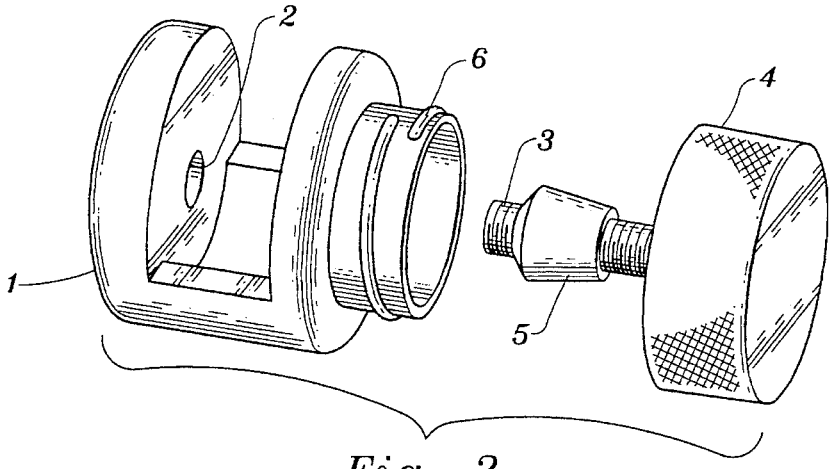
FIG. 2 Shows a perspective view of the firearm safety device with the trigger guard removed.
Figure 3:
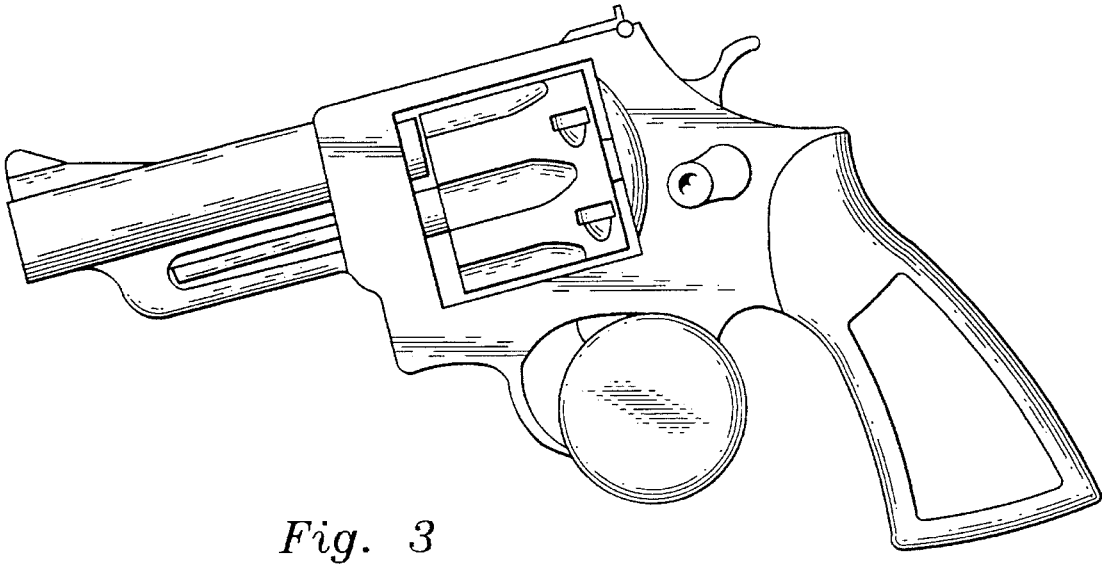
FIG. 3 Shows a side view of the firearm safety device installed on a firearm.

The firearm safety device as shown in FIG. 1 and 2 includes a block portion 1 which is a cylinder having half of the one wall cutaway for ingress of the trigger guard portion of a firearm. It also has a hole 2 for receiving the post 3 having a screw cap 4 at an opposite end and a sizing washer 5 for different sized trigger guards.

The safety device is attached by placing the block 1 over the trigger guard of a weapon and inserting the post 3 through the trigger guard as shown in FIG. 4 and into the hole 2 and engaging the threads of the block 1 by actuating the screw cap 4. It is also contemplated that the trigger post would rest in front of the trigger as well as behind the trigger as shown in FIG. 4, in that mode, the lock would be large enough to lodge against the handle as in a semi-automatic.

FIG. 5 shows the cross-sectional view and the operation of the sizing washer 5 which can be moved out of place when the interstice between the back of the trigger and the trigger guard as shown in FIG. 4 is too small. FIG. 6 shows a detailed view of the threads 6 and the inner cap 7 which locks down the post 3. FIG. 7 shows the operation of the outer cap 8 being depressed against the inner cap 7 so that the inner cap 7 can be rotated with respect to the thread 6. If the outer cap 8 is not depressed with sufficient force, it will no engage the teeth of 8 shown in FIG. 9 as shown in FIG. 8 with the teeth receptors 10 also shown in FIG. 8 and will spin freely.

This invention has been developed to provide a higher level of safety for children around guns. Previously guns were stored either in locked cabinets, without ammunition or with trigger lock guards in order to avoid the tragic accident of a child accidently firing a weapon. This device provides a simplistic solution to the problem of having a gun available for home safety. In order for a gun to be available for home safety it has to be at the ready. That is loaded and accessible. This invention solves those problems by providing a loaded and accessible gun that is inoperable by younger children. Further, this device is a secondary safety, all other safety devices can still be incorporated on the gun and the gun can be stored accessibly but still at elevations out of reach of young children.

Obviously many modifications and variations of the present invention are possible in light of the above teachings. It is therefor to be understood that within the scope of the appended claims, the invention may be practiced other than as specifically described.

What is claimed and desired to be protected by Letters Patent of the United States is:

1. An external firearm safety device comprising a block for fitting over a trigger guard of a firearm and a post for insertion in interstices between a trigger of said firearm and a back portion of said trigger guard wherein a child resistant cap means comprises an outer cap and an inner cap, said outer cap being in direct communication with said post and said inner cap being in direct communication with thread means to engage threads of said block such that when said threads are engaged, said post is engaged with said block such that when an operator wished to remove said safety device from said firearm pressure must be axially applied to said outer cap to engage engagement means of said inner cap in order to actuate said inner cap with respect to said threads and remove said outer and inner caps and posts from said block.

2. A device as described in claim 1 further comprising an adjustment washer for adapting to various sized interstices between said trigger and said back portion of trigger guard.

* * * * *